United States Patent [19]

Eckert et al.

[11] 4,287,043

[45] Sep. 1, 1981

[54] APPARATUS FOR ELECTRODEPOSITING A METALLIC LAYER OF PREDETERMINED THICKNESS

[75] Inventors: Werner Eckert; Wolfgang Simon, both of Erlangen, Fed. Rep. of Germany

[73] Assignee: Siemens Aktiengesellschaft, Munich, Fed. Rep. of Germany

[21] Appl. No.: 121,042

[22] Filed: Feb. 13, 1980

[30] Foreign Application Priority Data

Sep. 7, 1979 [DE] Fed. Rep. of Germany ..... 2936247

[51] Int. Cl.[3] ..... C25D 21/12; C25D 17/00

[52] U.S. Cl. ..... 204/228; 204/224 R

[58] Field of Search ..... 204/228, 224 R

[56] References Cited

U.S. PATENT DOCUMENTS

| | | | |
|---|---|---|---|
| 3,042,603 | 7/1962 | Kelley et al. | 204/228 |
| 3,669,868 | 6/1972 | Lieber et al. | 204/228 |
| 4,100,036 | 7/1978 | Rode et al. | 204/228 X |

FOREIGN PATENT DOCUMENTS

| | | | |
|---|---|---|---|
| 50-10256 | 4/1975 | Japan | 204/228 |
| 362072 | 2/1973 | U.S.S.R. | 204/228 |
| 401753 | 1/1974 | U.S.S.R. | 204/228 |
| 197708 | 9/1977 | U.S.S.R. | 204/228 |

*Primary Examiner*—Donald R. Valentine

*Attorney, Agent, or Firm*—Kenyon & Kenyon

[57] ABSTRACT

An apparatus for electrodepositing a layer of predetermined layer thickness has an anode supplied with DC voltage by a converter device. A programmable computer having inputs for the desired value of the layer thickness and for technological parameters, such as anode index and area factor, cyclically sums the current charge as the integral of current from digitized sampling values of the anodes current and determines therefrom the actual value of the layer thickness. When the desired thickness value is reached, the converter device is disconnected.

4 Claims, 2 Drawing Figures

APPARATUS FOR ELECTRODEPOSITING A METALLIC LAYER OF PREDETERMINED THICKNESS

BACKGROUND OF THE INVENTION

This invention relates to apparatus for electrodepositing a metallic layer having a particular thickness. More particularly, the invention relates to electrodeposition on an article in a metal-salt solution by means of a sacrificial anode which is connected to a DC voltage source, a current transformer for measuring the anode current, and a switching device for disconnecting the DC voltage source.

Such apparatus is used particularly for correcting etched or engraved printing cylinders for gravure printing where it is necessary for brightening the printed picture, by applying a layer of a given thickness in depressions of the printing cylinder in a limited correction area. The thickness of the layer applied depends on the magnitude of the anode current, the size of the anode, a material-dependent deposition equivalent, a shape-dependent current yield factor, the ratio of the size of the anode to the area of the correction region, and on the length of time. After the desired layer thickness is reached, the deposition process is to be terminated automatically.

There is need for an apparatus of the type mentioned above for use with a high degree of automation and having maximum flexibility in putting in the technological parameters.

SUMMARY OF THE INVENTION

According to the invention, this problem is solved by means of a programmable computer having an input for the desired value of the layer thickness, an input for technological parameter values, memories for storing the input data, and an arithmetic unit. The arithmetic unit cylically sums the charge, as the integral of current from digitized sampling values of the anode current over a normalized time period, and, taking the entered technological parameters into consideration, determines the actual value of the layer thickness, compares the actual value with the set desired value and delivers a disconnect signal when the layer thickness reaches the desired value.

It is advantageous to enter, as one technological parameter, an anode index which is determined from the size of the anode, the deposition equivalent and the current yield factor. An area factor is advantageously entered as another technological parameter; it is determined from the ratio of the anode area to the area of the correction region.

A particularly advantageous further embodiment of the invention provides a microprocessor as the computer, especially a single-chip microprocessor.

To facilitate operation of the apparatus, numerical displays of the cyclically determined actual value of the layer thickness and/or the predetermined set-in value of the layer thickness and/or the entered technological parameters are provided.

When a rectifier fed from the AC line is used as the DC voltage source, the anode current is a pulsating DC current. Cyclical sampling of the instantaneous value of the pulsating DC current by the computer would lead to erroneous results. However, an analog-to-digital converter can be used which has a large time constant and thus brings about practical smoothing of the measured anode current values. According to another advantageous feature of the invention, to avoid the expense of such converters, low-cost circuitry is provided in which an analog mean-value former following a current converter for measuring the anode current is followed by an analog-to-digital converter for digitizing the mean current values so provided.

Since the apparatus according to the invention is capable of setting-in any appropriate technological parameter, simple adaptation to all operating conditions is possible. Operation of the apparatus is extremely simple. Only the desired reference value for the layer thickness and the technological parameters need be entered. After the DC voltage source is connected, the sacrifical anode is passed over the correction area. As soon as the desired layer thickness is reached, the deposition process is interrupted automatically.

DETAILED DESCRIPTION OF THE INVENTION

Figure 1:
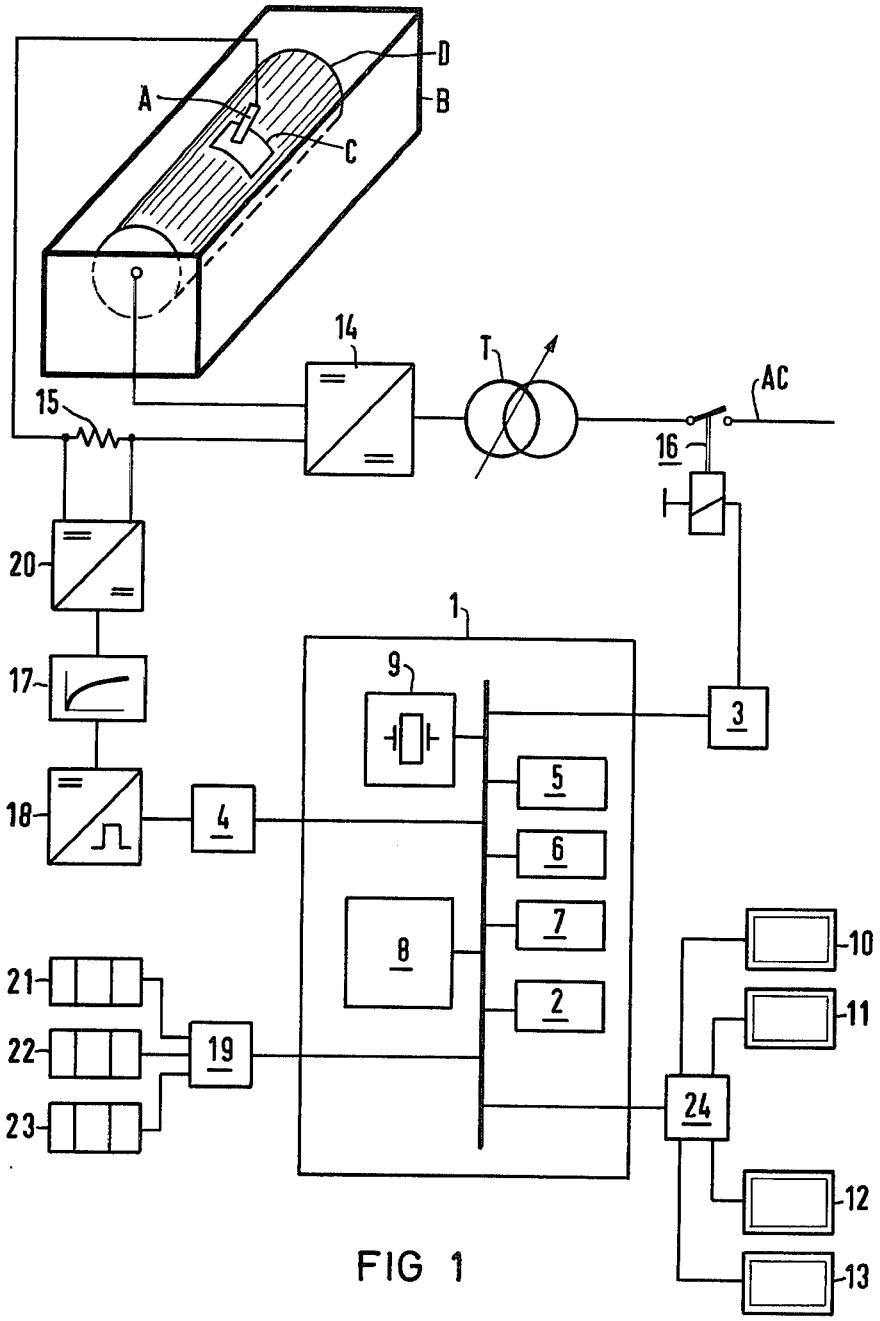
FIG. 1 is a block diagram illustrating an apparatus for correcting the gravure printing, according to the teachings of the invention.

In the illustrated embodiment, an already etched or engraved printing cylinder D is being reworked electrolytically in a correction station B, for instance, with a bivalent copper sulfate solution. An absorbent felt which is attached in front of a copper anode A serves as the electrolyte carrier. The copper anode A is passed over area C to be corrected and a copper layer is applied to printing cylinder D with a predetermined layer thickness of, say, 5 $\mu$m. Printing cylinder D and copper anode A are connected to a rectifier 14 as the DC voltage source. Rectifier 14 is supplied from an AC line via a contactor 16 and a variable transformer T. It is also possible to use a DC control element (chopper) instead of a rectifier preceded by a variable transformer. Rectifier 14 generates, for instance, a DC voltage of 0 to 15 V at a current of 25 A from a 220 Volt AC input. A shunt 15 is connected into the anode circuit from which an actual-value voltage proportional to the anode current is taken. The actual-value voltage is coupled d-c-wise via a DC current converter (voltage transformer) 20 to an analog mean-value former 17, such as a filter, which is followed by an analog-to-digital converter 18. Analog-to-digital converter 18 delivers a digitized mean value of the anode current, via an input unit 4, to the data bus of a computer 1.

Figure 2:
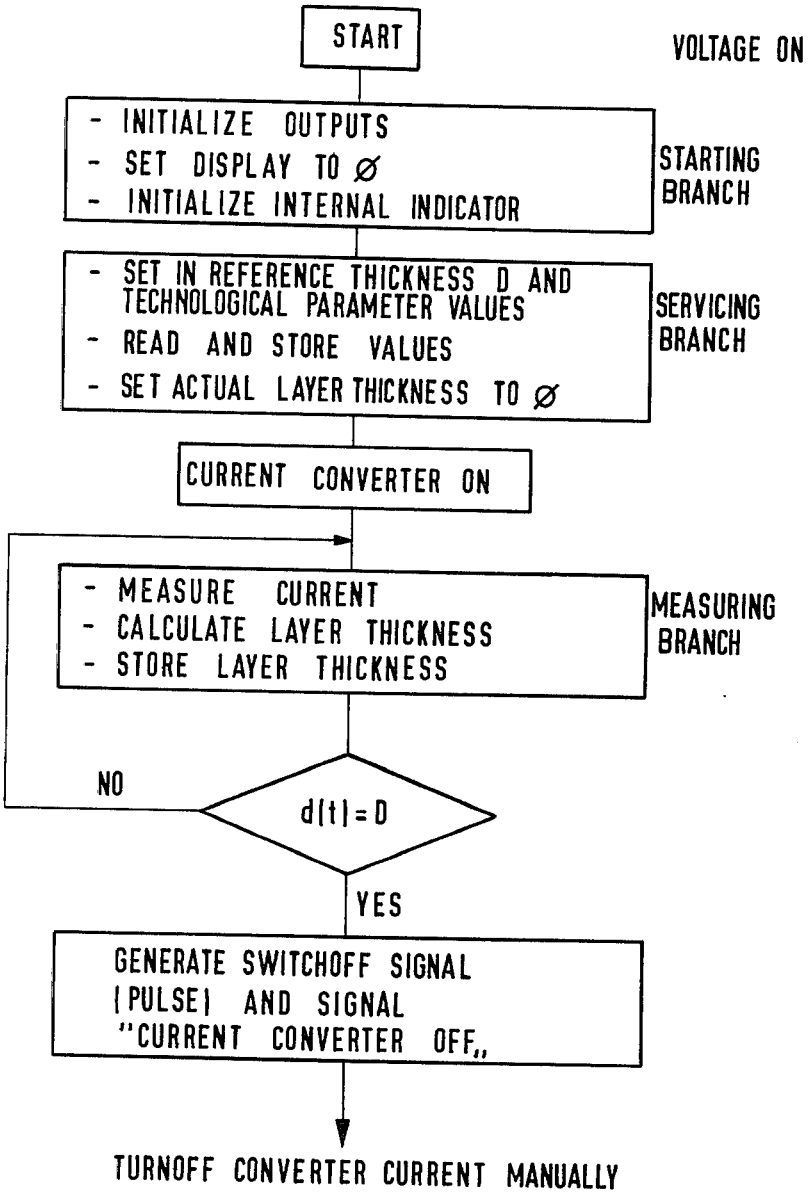
FIG. 2 is a flow diagram of a program for use with the computer of FIG. 1 for implementing the invention.

The design of the programmable computer 1, which may be realized as a microprocessor, is not the subject of the invention and is therefore shown only schematically. A flow sheet for use in programming such a computer is shown in FIG. 2. Computer 1 contains a data bus, to which are connected a program memory 2, a reference-value memory 5, parameter memories 6 and 7, an arithmetic unit 8, a time standard 9, and input units 4 and 19. An input device 21 for the reference value of the desired layer thickness, an input device 22 for an anode index, and an input device 23 for an area factor are connected to the computer via an input unit 19. The entered reference value and the entered technological parameters are stored in memories 5, 6, 7. Input devices 21, 22, 23 can also be of different design: in particular, a common or combined input device can also be provided, such as a keyboard.

The anode index is a proportionality factor which takes the influence of the size of the anode, the deposition equivalent and the current yield factor into consideration. The deposition equivalent depends on the material. For copper, for instance, the deposition equivalent is 282 As/dm$^2$ um. This means that a charge of 282 ampere-seconds is required to deposit a layer thickness of 1 $\mu$m on an area of 1 square decimeter. The current yield factor depends on the shape of the depressions into which the layer is to be electrodeposited. For large depressions the current yield factor is different than for shallow depressions. An average current yield factor can be assumed to be 0.96. The area factor is the ratio of the anode area to the area of the correction region C in which the layer of the desired thickness is to be deposited.

Computer 1 contains an arithmetic unit 8 which cyclically samples the actual mean value of the anode current provided by analog-to-digital converter 18 and sums it over time. A 3 MHz quartz crystal, for instance, is provided as time standard 9. Arithmetic unit 8 determines the actual value of the layer thickness therefrom, taking into consideration the technological parameters which are fed in. The layer thickness is calculated according to the following formulas:

$$d(t)=b\times Q(t)/a\times k\times AEQ$$

with $$Q(t) = \int_O^t i(t) \times dt,$$

where d(t)=actual layer thickness
i(t)=mean value of the anode current
Q(t)=charge
a=size of the anode
k=area factor
AEQ=deposition equivalent for a current yield factor of 100%
b=current yield factor.

For the calculation of layer thickness by means of arithmetic unit 8, the free selection of the input technological parameters is particularly advantageous. Thereby, the correction of the printing cylinders can be adapted accurately and reproducibly to the specific type of problem.

The calculated actual value of layer thickness is indicated in an output unit 24 having a numerical display 10. Another numerical display 11 on output unit 24 shows the predetermined reference value of the layer thickness, while the set-in anode index and the area factor are shown on still other numerical displays 12 and 13.

In arithmetic unit 8, the determined actual value of the layer thickness is compared each cycle with the set-in reference value according to the program flow diagram of FIG. 2. When the layer thickness reaches the set value, an output module 3 having a driver stage delivers a disconnect signal to switching device 16 and rectifier 14 is disconnected from line AC.

The flow diagram illustrates a program sequence suitable for carrying out the operation described above in a computer. Reading from top to bottom, it includes turning on the computer, setting the computer outputs and the internal indicator to the desired initial condition, and setting the actual thickness, preset thickness, and set-in technological parameter displays to zero. The reference thickness D and the appropriate technological parameters are manually inserted at the inputs. The computer then reads the inserted values, making them available to the arithmetic unit, and sets the actual layer thickness register to zero.

The computer then turns on the current converter ("current converter on") and measures the current. The layer thickness is calculated according to the formula above, taking the technological parameters into account, and the calculated thickness is stored and displayed.

The computer then compares the calculated actual thickness value with the reference thickness D, and, if the actual thickness is less than the desired thickness, the measurement cycle is repeated. When the calculated actual thickness equals the pre-set desired thickness, the computer generates a disconnect signal, which may be a pulse, via output unit 3, activating disconnect device 16 and turning off the power. The current converter may be turned off manually while the unit is prepared for another job.

As the arithmetic unit, a single-chip microprocessor such as is sold, for instance, by SIEMENS AG under the designation SAB 8748, is particularly well suited for use.

The application of the invention is not limited to its use for correcting gravure printing cylinders. It can be employed wherever a layer of predetermined layer thickness is to be electrodeposited in a given area of other articles.

What is claimed is:

1. An apparatus for electrodepositing a metallic layer of predetermined thickness on a correction area of an article in a metal salt solution comprising:

a sacrificial anode;

a source of DC voltage connected to the anode;

means for measuring the current flowing from the DC voltage source to the anode and providing a current measurement signal representing mean current values;

a computer having an anode index parameter, an area factor, the current measurement signal, and the predetermined thickness as inputs, and comprising means for cyclically calculating the actual value of thickness of the layer deposited on the correction area, comparing the calculated thickness so obtained with the predetermined thickness, and generating a disconnect signal when the calculated thickness is equal to the predetermined thickness, the deposited thickness being calculated according to the relationship $$d(t)=(b\cdot a)/AEG\cdot Q(t)\cdot 1/k$$

where:

d(t) is the actual thickness, (b·a)/AEG is the anode index derived from the current yield factor b, the anode area a, and the deposition equivalent AEG, Q(t) is the total charge summed from successive mean values of anode current, k is the area factor; and means for disconnecting the anode from the source of DC voltage in response to the disconnect signal.

2. An apparatus according to claim 1, in which the computer is a single-chip microprocessor.

3. An apparatus according to claim 1, further comprising the computer having at least one of a numerical display for the cyclically determined actual value of the layer thickness, a numerical display for the predetermined reference value of the layer thickness, and a numerical display for a technological parameter.

4. An apparatus according to claim 1 in which the means for measuring the anode current comprises a current transformer having the anode current as an input and having an output coupled via an analog mean-value former to an analog-to-digital converter, the output of the converter being coupled to the computer as an input.

* * * * *